US005339466A

United States Patent [19]

McMullen

[11] Patent Number: 5,339,466

[45] Date of Patent: Aug. 23, 1994

[54] COLD WEATHER SLEEPING HOOD

[76] Inventor: Donald J. McMullen, Saint Mary's College - 1500, 700 Terrace Heights, Winona, Minn. 55987-1399

[21] Appl. No.: 819,105

[22] Filed: Jan. 9, 1992

[51] Int. Cl.[5] ..... A42B 1/06

[52] U.S. Cl. ..... 2/203; 2/84; 2/202

[58] Field of Search ..... 2/2, 84, 171, 202, 203, 2/204, 205, 410, 423

[56] References Cited

U.S. PATENT DOCUMENTS

| | | | |
|---|---|---|---|
| D. 304,257 | 10/1989 | Dorning | D2/181 |
| 768,626 | 8/1904 | Rautenberg . | |
| 787,945 | 12/1905 | Rautenberg . | |
| 1,529,981 | 3/1925 | Biton | 2/84 |
| 2,313,458 | 3/1943 | Tucker | 2/84 |
| 2,368,654 | 2/1945 | Frank | 2/84 |
| 2,441,745 | 5/1948 | Benamy | 2/84 |
| 2,448,021 | 8/1948 | DeGrazia | 2/205 |
| 2,581,366 | 1/1952 | DeGrazia | 2/203 |
| 2,839,757 | 6/1958 | Gianola | 2/205 |
| 2,870,452 | 1/1959 | De Grazia | 2/203 |
| 3,594,814 | 7/1971 | Schuessler | 2/205 |
| 3,698,014 | 10/1972 | Little | 2/202 |
| 4,768,235 | 9/1988 | Webster | 2/84 |
| 4,949,887 | 8/1990 | Holmes | 2/202 |
| 5,077,838 | 1/1992 | Senser | 2/84 |
| 5,101,513 | 4/1992 | Bowers | 2/84 |

FOREIGN PATENT DOCUMENTS

| | | | |
|---|---|---|---|
| 175594 | 6/1961 | Sweden | 2/202 |

OTHER PUBLICATIONS

Catalogue pp. 43–45 from Recreational Equipment Inc. (REI), Reading, Mass.

*Primary Examiner*—Clifford D. Crowder
*Assistant Examiner*—Diana L. Biefeld

[57] ABSTRACT

The cold weather sleeping garment of the instant invention, used in conjunction with a sleeping bag, allows a user to sleep in sub-zero temperatures. The sleeping garment is separate from the sleeping bag but comfortably and snugly fastened to the user. The sleeping garment moves with the body which eliminates claustrophobia and loss of insulating value caused by displacement of the breathing hole away from the nose and mouth area of the user. By virtue of its ability to hug the body of the user and move with the user, the hole stays where placed initially with little or no displacement from the face. The shoulder protection serves to separate the bag into two sections preventing warm air in the bag and surrounding the user from being pushed out of the breathing hole when the user moves. An adaptation of the sleeping garment of the instant invention allows the insertion or removal of additional insulating material which affords the user greater comfort in changing weather conditions.

6 Claims, 3 Drawing Sheets

COLD WEATHER SLEEPING HOOD

BACKGROUND OF THE INVENTION

1. Field of the Invention.

This invention relates to a garment which prevents the loss of heat experienced with using mummy-style sleeping bags in very cold weather. More particularly, it relates to a sleeping garment which allows free movement in a sleeping bag while preventing the usual continual loss of heat through the breathing opening.

2. Prior Art

Most of the art in this area relates to attempts to design hoods which allow the wearer to stay warm while moving about in very cold weather. Attempts as early as 1904 included head, face and neck mufflers made of knitted wool and fitted closely to the head shape, as in U.S. Pat. No. 768,626 issued Aug. 30, 1904 and U.S. Pat. No. 787,945 issued on Apr. 25, 1905 both issued to Bernard Rautenberg. Other hoods which are adapted to be worn with other garments are disclosed in U.S. Pat. No. 2,839,757 issued Jun. 24, 1958 to S. V. Gianola, U.S. Pat. No. 2,870,452 issued Jan. 27, 1959 to J. De Grazia, and U.S. Pat. No. 4,768,235 issued Sep. 6, 1988 to M. Webster. These patents all focus on keeping the wearer warm while providing unobstructed vision. Design patent No. Des. 304,257 issued Oct. 31, 1989 to Dorning also shows a detachable hood and dickey combination which would enable the wearer to move about in cold weather.

The instant invention relates specifically to the equipment necessary for cold weather camping, necessitating sleeping at very low temperatures. At present, the best attempt to provide warmth to cold weather campers is a mummy-style sleeping bag which is a single piece sleeping unit with a drawstring in the face area which forms a breathing hole. This design, however, has two significant problems. First, if the sleeping person moves, the breathing hole is no longer centered over the nose and mouth. This causes condensation from the breath to settle in the hood of the bag thereby reducing its insulating value. Second, as the sleeping person moves in the bag, warm air gets pushed out through the breathing hole and cold air gets drawn in. This results in the continual loss of heat throughout the night. Unsuccessful attempts to solve this problem include the use of a special baffle around the neck. The most recent attempt to solve this problem is cold weather sleeping bags with a "draft collar" or "shoulder gasket" and a hood-shaped curve at the entrance to the bag. Normally the bag will be zipped first, then the hood drawstring will be tightened as much as one wants and finally the drawstring on the collar will be tightened. When the user gets to this last step there is not sufficient room for maneuvering the arms up around the shoulders making it difficult to adequately close the drawstring. Also, it is often difficult to find the drawstring due to this limited arm movement. In the alternative, the user could adjust the draft collar then zip up the bag last. However, this would still require one to snug-up the hood first, which would made it difficult to close the last few inches of the zipper.

For example, the most advance state of the art before the invention of the subject matter of this application involved an awkward procedure for securing a mummy-style sleeping bag. The advanced cold weather mummy-style sleeping bags have baffles or "gaskets" sewn into the inside of the bag in the shoulder area.

Generally, one would get into the sleeping bag and put the baffles or gaskets in place over the shoulders. Then, with little room to maneuver one would zip the zipper up the side to the neck. Last, while so secured, one would have to reach the drawstring of the mummy-style hood (which is continuous with the entire bottom of the sleeping bag). With limited arm movement, this would require one to wriggle one's fingers through the neck hole formed by the shoulder gasket and pull down on the drawstring. Also, since the bags are standard size, the gasket must be located in the shoulder area of the average sleeping bag user. Accordingly, the tall or short user may find the location of the gasket unsatisfactory.

SUMMARY OF THE INVENTION

In accordance with the present invention, it was discovered that a separate piece could eliminate the difficulty of getting into and properly fitting the insulating pieces of cold weather sleeping bags. The design of a separate sleeping garment of the instant invention would eliminate problems experienced with the use of the hood and gasket combination of the mummy-style sleeping bags. An adaptation of the sleeping garment of the instant invention allows the insertion or removal of additional insulating material which affords the user greater comfort in changing weather conditions.

Accordingly, it is an object of the present invention to allow movement while sleeping while keeping the breathing hole centered around the mouth and nose.

It is a further object of the present invention to prevent warm air from being pushed out and cold air being sucked in through the breathing hole.

It is another object of this invention to allow freer arm movement while in the bag enabling the user to easily secure and adjust the sleeping garment.

It is another object of this invention to simplify the procedure to get set up for sleeping in cold weather sleeping bags.

It is a further object of this invention to tailor fit the shoulder portion of the hood of the instant invention at the exact location of the shoulder of the user.

It is still a further object of this invention to allow the user to adapt to weather changes by allowing the removal or insertion of an insulating liner into the hood.

DETAILED DESCRIPTION OF THE INVENTION

This invention solves the loss of warm air and intake of cold air caused by the usual movement of a sleeper throughout the night. By virtue of its ability to hug the body of the user and move with the user, the hole stays where placed initially with little or no displacement from the face. Also, the shoulder protection serves to separate the bag into two sections, as the baffle or shoulder gasket of the prior art was intended to do. The shoulder protection of the instant invention works more efficiently because the shoulder portion of the sleeping garment also follows the movement of the shoulders of the sleeper. Thus, the seal is not temporarily broken by the displacement of the shoulders as occurs when the shoulder gasket is attached to the bag. Also unlike the conventional sewn-in gasket the shoulder protection of the instant invention extends across the chest, over the shoulders and down across the upper back.

This invention solves some of the problems experienced with using mummy-style sleeping bags in very cold weather. The features of the present invention greatly simplify the procedure for securing the user in a sleeping bag. The user would first place the hood on (and may or may not pull drawstring of the sleeping garment at this point) and then get into the bag. The bag is then zipped. The arms are free to reach up and pull the drawstring of the sleeping bag around the neck. If not already drawn closed, the drawstring of the sleeping garment would be drawn at this time. At present, it is believed that only mummy-style (i.e., with hood) sleeping bags have drawstrings. The present invention would obviate the need for the hood extension of the mummy-style bag. That is, a conventional non-hooded bag could now be equipped with a drawstring which would allow closing around the neck. However, this model was designed and tested with mummy-style bags.

DESCRIPTION OF PREFERRED EMBODIMENT

Figure 1:
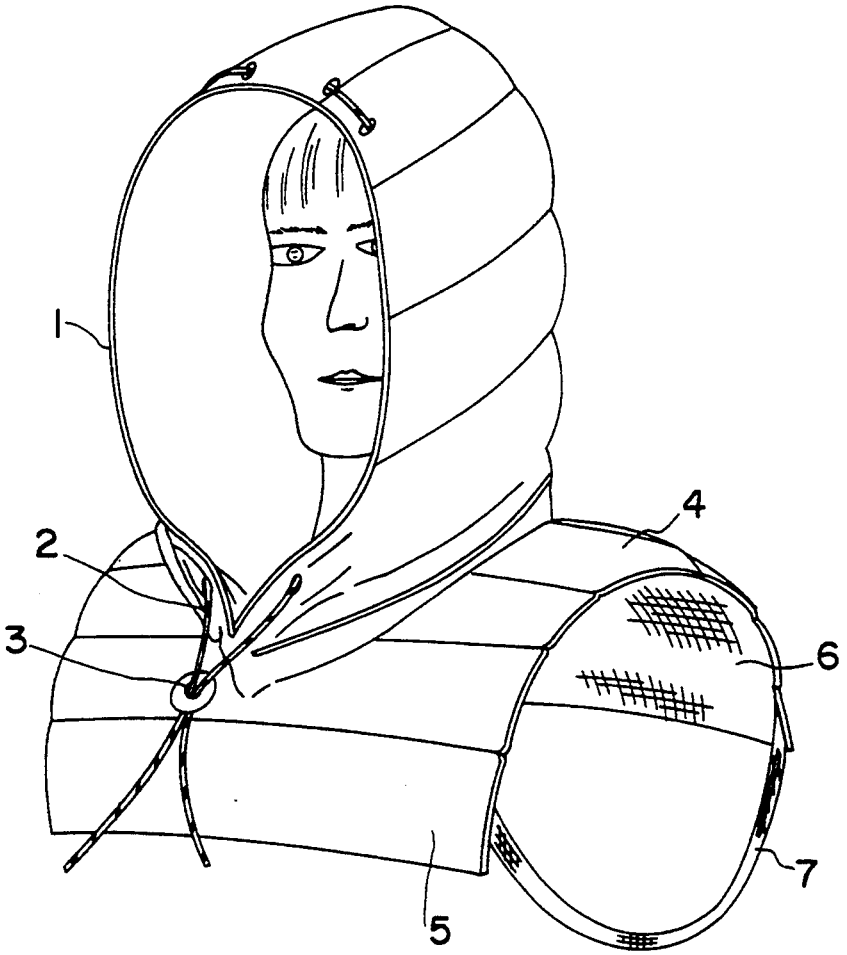
FIG. 1 is a diagram of the sleeping garment of the instant invention in its open state.
Figure 2:
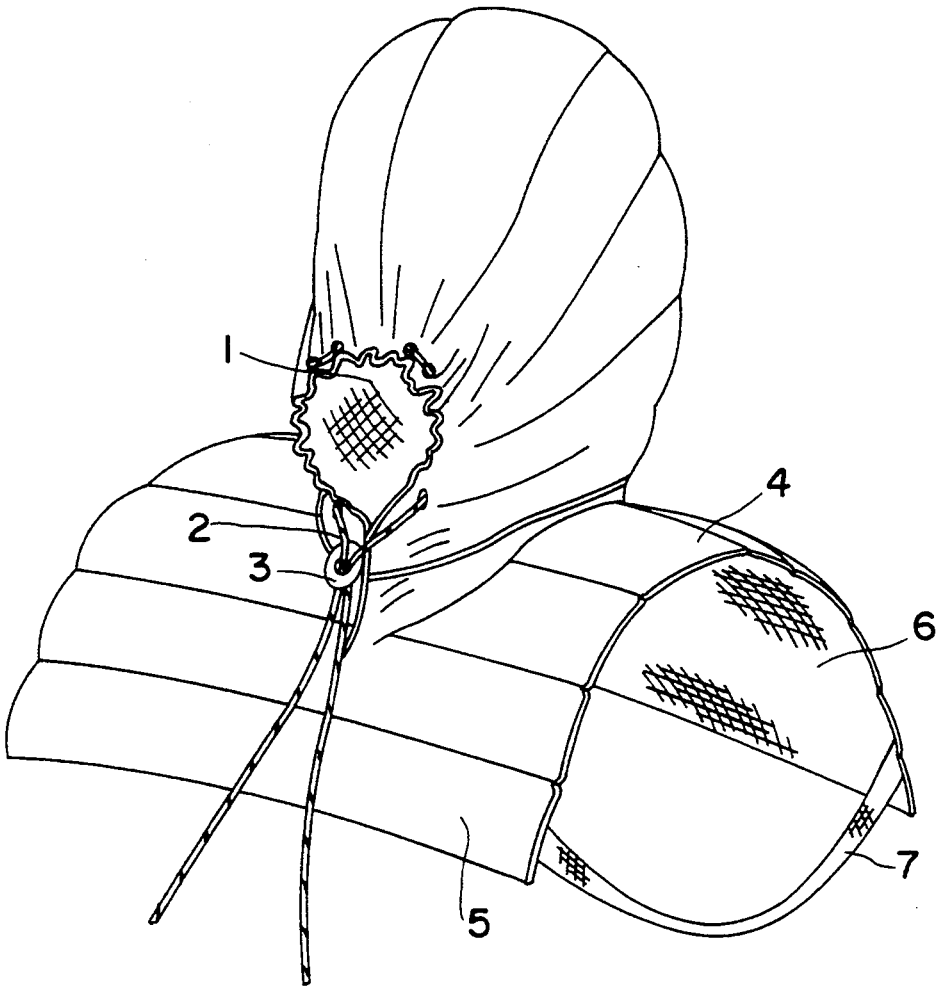
FIG. 2 is a diagram of the sleeping garment of the instant invention in its closed state as it would be used during sleeping.

As shown in the drawings, in the preferred embodiment, the user would place his/her arms through the underarm securing means 7 and the head through the neck of the hood so that the deformable hood 1 would be in position over the head with the face exposed and with the shoulder portion 4 resting squarely on the shoulders of the user. The chest portion 5 would be extending forward from the shoulder portion 4 so that the chest was protected from drafts. The upper back portion 6 would extend rearward from the shoulder portion 4 protecting the upper back from drafts and giving a secure fit. As shown in FIG. 2, to operate the sleeping garment of the instant invention, the drawstring 2 would be pulled thereby constricting the size of the face opening and secured in place by a drawstring lock 3. Many different types of drawstring locks are known in the art any of which could be used. In the preferred embodiment, for maximum insulation, the opening would only be located around the mouth and nose region. The deformable hood 1 would have ample material to cover the forehead and eyes when in use. This unique feature minimizes loss of heat by restricting the opening only to the minimal amount necessary to breath since vision is not a factor in sleeping gear. Further, the underarm securing means 7, as well as other features of the instant invention, keep the opening centered because the sleeping garment must turn with the body as the user moves. Accordingly, there is no condensation of the user's breath inside the bag which, in turn, maintains the insulating value of the hood. This is important because 30–40% of body heat is lost through the head. The thickness of insulating material can range widely due to the large variety of insulating material available. At present, a thickness equal to or greater than ½ inch is used. However, it is conceivable that newer and less thick insulating materials with equal insulating values will be developed and could be used in the fabrication of the instant invention.

The material used for the preferred embodiment of the sleeping garment is nylon onto which ½ to 1 inch of Fiberfill adheres. Accordingly, the total amount of insulating material in the preferred embodiment is 1 to 2 inches fiberfill insulation in between the outer and inner shells. The outer shell is the side of the sleeping garment exposed to the elements and the inner shell is the side which touches the body of the user. For maximum comfort, a soft nylon taffeta is used for the inner shell because of its soft feel against the skin. Additionally, a ½ inch layer of Thinsulate can used to line the deformable hood 1 but this does not extend to the chest portion 5, the shoulder portion 4 and the upper back portion 6.

Figure 3A:
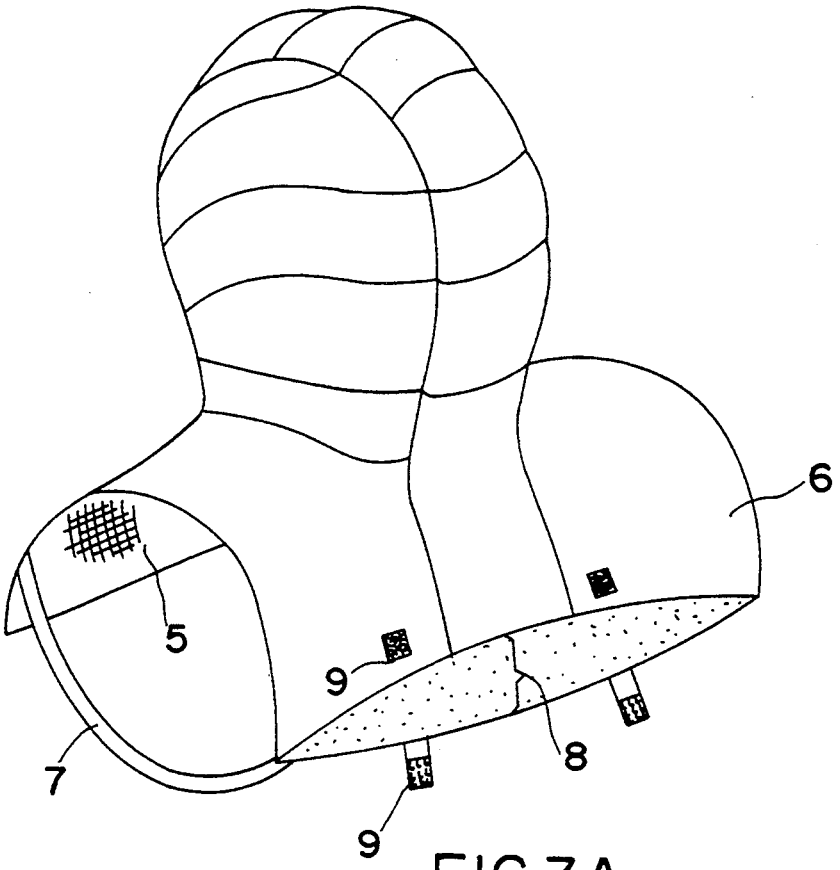
FIG. 3A is a view from the back and side of the sleeping garment of the instant invention showing the optional longitudinal slit feature. The face opening is not visible from this view.
Figure 3B:
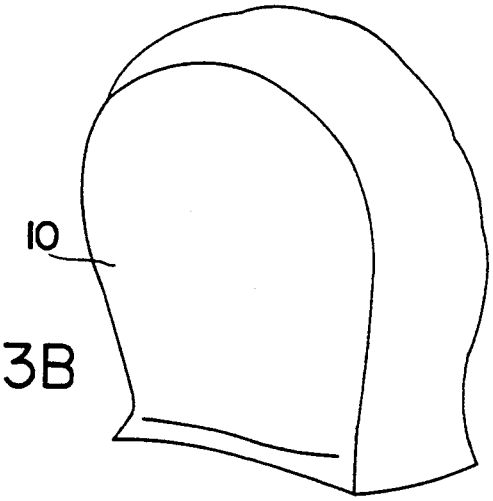
FIG. 3B is a back and side view of the removable insulating material in the form of a hood which can be inserted into or removed from the garment shown in FIG. 3A.

In another embodiment of the instant invention as shown in FIG. 3A, the insulating material in the deformable hood 1 can be adjusted according to the weather by adding or removing insulating material through a longitudinal slit 8 at the base of the upper back portion 6 of the sleeping garment. This longitudinal slit 8 is sufficiently large to allow easy insertion or removal of the removable lining hood 10. FIG. 3B shows the removable lining hood 10 constructed of insulating material shaped to fit exactly into the deformable hood 1. Fasteners 9, preferably hook and loop, secure the longitudinal slit when closed. In the preferred embodiment, ½ inch Thinsulate is used for the removable lining hood 10. Other insulating materials in various thicknesses including, but not limited to, wool or Fiberfill could also be used. As used herein Fiberfill and Thinsulate are examples of acceptable insulating material. More generally the insulating material is any thermal insulation made of non-woven, extruded synthetic fibers which fibers entrap air, more particularly, comprising fibers selected from the group consisting of polyester, olefin or blends thereof. The adaptability of the hood to allow for wide ranges of temperatures is highly desirable and impossible to achieve with the fixed insulating features of the prior art, for example, the standard thickness of the mummy-style bag.

What is claimed is:

1. A cold weather sleeping garment comprising;

a hood with front, back and neck areas with a deformable face opening in the front which hood is adapted to be used with or without an insulating liner;

a drawstring housing means surrounding the deformable face opening;

a drawstring means to close the deformable face opening of the hood which hood is of sufficient size to allow said drawstring means to deform the face opening into a position over the mouth and nose region of a wearer which when constricted allows the wearer to breathe with minimum exposure of the wearer's skin to the air outside the hood;

a drawstring lock to hold the drawstring in position;

a shoulder covering portion connected at the neck area of said hood which when used in combination with a sleeping bag forms a seal between the garment and the sleeping bag;

a chest portion which is a forward extension of the shoulder covering portion;

an upper back portion with a rear base portion which is a rearward extension of the shoulder covering portion adapted with a slit at the rear base which accommodates the insertion or removal of optional insulating material;

fasteners to secure the slit when closed;

optional insulating material adapted to the shape of the hood; and underarm securing means which connect each side of the upper back to the chest portion said underarm securing means being sized to provide minimal restriction of movement of the wearer while securely maintaining the garment in a stable position in relation to the wearer when the wearer moves;

wherein each of said hood, shoulder covering portion, chest portion and upper back portion comprises an inner and an outer shell.

2. The sleeping garment of claim 1 wherein the outer and inner shells are nylon with ½ to 1 inch layer of thermal insulation.

3. The sleeping garment of claim 1 further comprising thermal insulating material between the outer and inner shells which insulating material has a thickness of about 1 to 2 inches.

4. The sleeping garment of claim 1 further comprising a soft nylon taffeta material for the inner shell.

5. The sleeping garment of claim 1 wherein the fasteners are hook and loop.

6. The sleeping garment of claim 1 further comprising insulating material between the outer and inner shells which insulating material has a thickness greater than ¼ inch.

* * * * *